US010344557B2

(12) United States Patent
Van Dongen

(10) Patent No.: US 10,344,557 B2
(45) Date of Patent: Jul. 9, 2019

(54) METHOD OF SEALING A FRACTURE IN A WELLBORE AND SEALING SYSTEM

(71) Applicant: Total E&P Danmark A/S, Copenhagen Ø (DK)

(72) Inventor: Hans Johannes Cornelis Maria Van Dongen, Copenhagen K (DK)

(73) Assignee: TOTAL E&P DANMARK A/S, København Ø (DK)

( * ) Notice: Subject to any disclaimer, the term of this patent is extended or adjusted under 35 U.S.C. 154(b) by 213 days.

(21) Appl. No.: 15/301,635

(22) PCT Filed: Mar. 3, 2015

(86) PCT No.: PCT/EP2015/054345
§ 371 (c)(1),
(2) Date: Oct. 3, 2016

(87) PCT Pub. No.: WO2015/132219
PCT Pub. Date: Sep. 11, 2015

(65) Prior Publication Data

US 2017/0191345 A1 Jul. 6, 2017

(30) Foreign Application Priority Data

Mar. 3, 2014 (GB) ..... 1403666.9

(51) Int. Cl.
*E21B 33/138* (2006.01)
*E21B 43/25* (2006.01)
(Continued)

(52) U.S. Cl.
CPC ..... *E21B 33/138* (2013.01); *E21B 17/18* (2013.01); *E21B 33/124* (2013.01); *E21B 43/11* (2013.01); *E21B 43/25* (2013.01); *E21B 47/06* (2013.01); *E21B 43/26* (2013.01)

(58) Field of Classification Search
CPC ..... E21B 33/13; E21B 33/138; E21B 17/18; E21B 33/124; E21B 43/11; E21B 43/25; E21B 47/06; E21B 43/26
See application file for complete search history.

(56) References Cited

U.S. PATENT DOCUMENTS 3,825,070 A 7/1974 Hoyt
4,809,780 A 3/1989 Shen
(Continued)

FOREIGN PATENT DOCUMENTS

EP 1184537 B1 11/2005

OTHER PUBLICATIONS

Search report for Great Britain Application No. GB1403666.9, dated Sep. 16, 2014.
(Continued)

*Primary Examiner* — Zakiya W Bates
*Assistant Examiner* — Crystal J Miller
(74) *Attorney, Agent, or Firm* — Brinks Gilson & Lione

(57) ABSTRACT

In a method of sealing a fracture (1) in a formation (2) surrounding a wellbore provided with a non-cemented perforated liner (4), a placement tool (6) is introduced into the liner, and a first and second annular flow barrier (8, 9) create an upstream (10), an intermediate (11) and a downstream section (12). A cross flow shunt tube (13) connects the upstream section and the downstream section, and a sealing fluid outlet (14) is arranged in the intermediate section. A placement fluid is caused to flow into the fracture and controlled to obtain a desired fluid flow in an annular space between the liner and the formation that is directed in downstream direction at a position upstream the fracture and in the upstream direction at a position downstream the
(Continued)

fracture. When said desired flow is obtained, sealing fluid is ejected from the sealing fluid outlet. A sealing system is furthermore disclosed.

23 Claims, 1 Drawing Sheet

(51) Int. Cl.

| | |
|---|---|
| ***E21B 43/26*** | (2006.01) |
| ***E21B 17/18*** | (2006.01) |
| ***E21B 33/124*** | (2006.01) |
| ***E21B 43/11*** | (2006.01) |
| ***E21B 47/06*** | (2012.01) |

(56) References Cited

U.S. PATENT DOCUMENTS

| | | | | |
|---|---|---|---|---|
| 4,842,068 | A | 6/1989 | Vercaemer et al. | |
| 5,002,127 | A * | 3/1991 | Dalrymple | C09K 8/50 166/285 |
| 5,161,613 | A | 11/1992 | Jones | |
| 5,464,059 | A | 11/1995 | Kristiansen | |
| 6,772,839 | B1 * | 8/2004 | Bond | E21B 23/04 166/100 |
| 2006/0042795 | A1 | 3/2006 | Richards | |
| 2014/0238668 | A1 * | 8/2014 | Bittleston | E21B 43/26 166/250.01 |
| 2015/0267500 | A1 * | 9/2015 | Van Dongen | E21B 33/13 277/336 |
| 2017/0030174 | A1 * | 2/2017 | Van Dongen | E21B 43/162 |
| 2017/0044863 | A1 * | 2/2017 | Van Dongen | E21B 47/1025 |

OTHER PUBLICATIONS

International Search Report and Written Opinion for PCT/EP2015/054345, dated Jul. 14, 2015.

Preliminary Report on Patentability for PCT/EP2015/054345, dated Sep. 6, 2016.

* cited by examiner

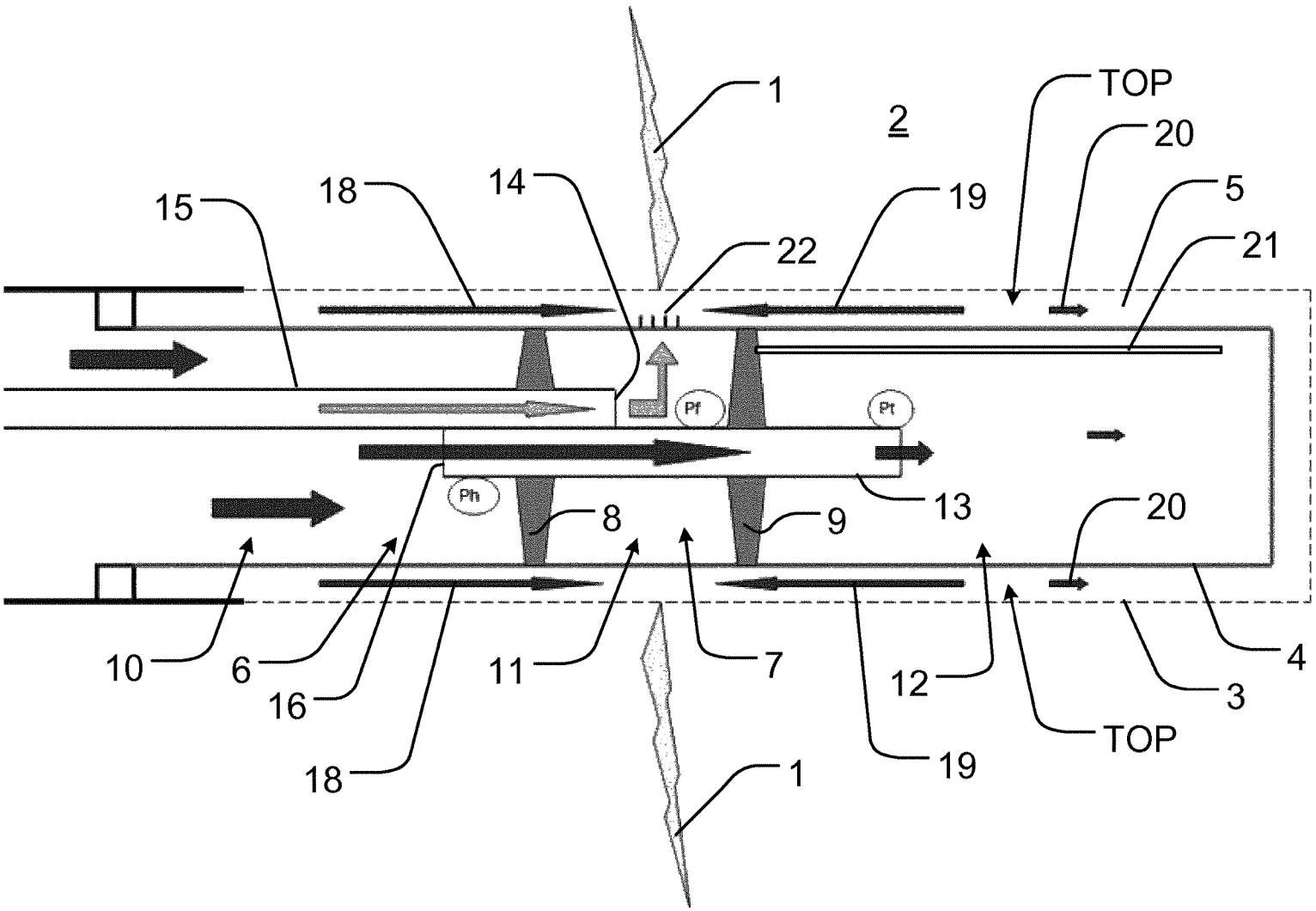
TOP
20
5
21
4
3
20
TOP
2
19
13
12
19
1
22
9
7
1
14
8
11
18
16
6
18
15
10
Pt
Pf
Ph

METHOD OF SEALING A FRACTURE IN A WELLBORE AND SEALING SYSTEM

RELATED APPLICATIONS

This application claims the benefit under 35 U.S.C. § 371 of the filing date of International Patent Application No. PCT/EP2015/054345, having an international filing date of Mar. 3, 2015, which claims priority to Great Britain Application No. 1403666.9, filed Mar. 3, 2014, the contents of both of which are incorporated herein by reference in their entirety.

The present invention relates to a method of sealing a fracture or thief zone in a formation of a hydrocarbon reservoir surrounding a wellbore section of a wellbore having an upstream direction and a downstream direction, the wellbore section being provided with a non-cemented perforated liner, thereby forming an at least substantially annular space between the non-cemented perforated liner and the formation.

Recovery of hydrocarbons from subsurface reservoirs involves the drilling of one or more wells to the depth of the hydrocarbon reservoir. After well completion, the reservoir can be drained for hydrocarbon fluids that are transported to the surface.

The reservoir typically has different zones with different permeability. If the permeability of one zone is higher than the average permeability in the rest of the reservoir, it may be referred to as a so-called thief zone.

Thief zones are common in hydrocarbon reservoirs and may increase the risk of a production well producing large volumes of water if such thief zone connects a production well to a source of water. Fluid can also flow via fractures in the reservoir.

A problem frequently encountered in wells intended for water injection is channelling of substantial quantities of water from an injection well to production wells, caused by the existence of natural or manmade thief zones in the form of channels or fractures in the reservoir.

Consequently, much effort has gone into developing methods and products that reduce the negative impact of such thief zones, channels or fractures.

Thief zones are normally sealed off by injecting a sealing fluid into the relevant part of the formation. The sealing fluid may, according to prior art solutions, simply be applied under pressure in the vicinity of a known thief zone or fracture and will then follow the track of least resistance into the thief zone or fracture. However, this solution is not feasible in connection with non-cemented perforated liner, as the sealing fluid may travel along the liner in the annular space formed between the non-cemented perforated liner and the formation. Thereby, it could happen that parts of the formation not constituting a thief zone or fracture would be plugged by the sealing fluid, thereby negatively influencing the well.

A specific type of non-cemented perforated liner is the so-called Controlled Acid Jet (CAJ) liner. These liners have a perforation optimized for acid stimulation of a well, and may subsequently to acid stimulation be used for water injection or oil production. A CAJ liner typically has a hole distribution whereby the total hole area per length unit of the liner increases from the heel (the inner part of the wellbore) to the toe (the outer part of the wellbore). Thereby, efficient acid stimulation of the complete wellbore section may be achieved, as the hole distribution may compensate for the pressure loss along the wellbore. A CAJ liner is described in EP 1 184 537 B1 (Maersk Olie og Gas A/S).

U.S. Pat. No. 4,842,068 discloses a method for selectively treating a subterranean formation without affecting or being affected by the two adjacent zones (above and below). Using this process, the treatment fluid is injected into the formation to be treated, at the same time as two protection fluids are injected into the two adjacent zones (above and below). The process can be applied even in the presence of fractures, gravel-pack and their zones. However, this method may be unsuitable in a wellbore provided with a non-cemented perforated liner, and specifically unsuitable in a wellbore provided with a (CAJ) liner as described above. The limited number of holes in a non-cemented perforated liner may prevent proper distribution of the protection fluids.

Therefore, accurate sealing of thief zones or fractures may not be possible by use of this method.

The object of the present invention is to provide a method of sealing a fracture or thief zone in a formation surrounding a wellbore section provided with a non-cemented perforated liner without negatively influencing the remaining part of the wellbore section.

In view of this object, a placement tool including an elongated body is introduced into the non-cemented perforated liner so that a first and a second annular flow barrier arranged on the elongated body extend to the liner and create inside the liner an upstream section, an intermediate section between the first and second annular flow barriers, and a downstream section, the placement tool includes a cross flow shunt tube allowing wellbore fluids to pass along the wellbore section between the upstream section and the downstream section, a sealing fluid outlet of the placement tool is arranged in the intermediate section, the placement tool is so positioned in the longitudinal direction of the wellbore section that the intermediate section is located at the fracture or thief zone in the formation, a placement fluid, such as sea water, is caused to flow into the fracture or thief zone in the formation by injection of placement fluid into the non-cemented perforated liner in the downstream direction so that placement fluid flows out through perforations of the non-cemented perforated liner and/or by production from an adjacent wellbore in the formation, the placement fluid injection and/or the production in the adjacent wellbore is controlled to obtain a desired fluid flow in the at least substantially annular space between the non-cemented perforated liner and the formation that is directed in downstream direction at a position upstream the fracture or thief zone and that is directed in the upstream direction at a position downstream the fracture or thief zone, and, when said desired fluid flow is obtained, sealing fluid is ejected from the sealing fluid outlet into the formation.

In this way, the sealing fluid may be guided and/or carried into the fracture or thief zone by means of a current created by the injected placement fluid, such as sea water, or created by the suction pressure in the adjacent wellbore, said current being formed in the at least substantially annular space between the non-cemented perforated liner and the formation and being directed at the fracture or thief zone from both upstream and downstream sides. Thereby, proper placement of the sealing fluid in the fracture or thief zone may be obtained even by limited access through the perforations of the liner, and the remaining part of the wellbore section may thereby be protected from the sealing fluid by the current created by the placement fluid.

In an embodiment, the placement fluid injection is controlled to obtain said desired fluid flow by controlling a placement fluid inflow rate at an upstream position of the wellbore section. Thereby, the desired fluid flow and thereby a proper placement of the sealing fluid in the fracture or thief zone may be achieved for instance by controlling the pumping rate of a pump placed above the wellbore. The pumping rate may be controlled on the basis of a comparison of a registered fluid flow and said desired fluid flow in the at least substantially annular space between the non-cemented perforated liner and the formation. Additionally or alternatively, the production in an adjacent wellbore may be controlled to obtain said desired fluid flow by controlling a fluid outflow rate at an upstream position of the adjacent wellbore.

For instance, if the fluid flow in the at least substantially annular space between the non-cemented perforated liner and the formation is directed in the downstream direction at a position downstream the fracture or thief zone, this may be an indication that the fluid inflow rate is too low, and this rate may therefore be increased in order to reverse said fluid flow.

In an embodiment, the placement fluid injection is controlled to obtain said desired fluid flow by controlling a flow rate through the cross flow shunt tube in relation to a placement fluid inflow rate at an upstream position of the wellbore section. For instance, the cross flow shunt tube may be provided with a pump, whereby the flow rate through the cross flow shunt tube may be increased or even decreased. The cross flow shunt tube may also be provided with a valve. Thereby, the relation between the rate of placement fluid supplied to the upstream section and the downstream section, respectively, of the non-cemented perforated liner may be controlled, so that said desired fluid flow is obtained.

For instance, if the fluid flow in the at least substantially annular space between the non-cemented perforated liner and the formation is directed in the downstream direction at a position downstream the fracture or thief zone, this may be an indication that the flow rate through the cross flow shunt tube is too low, and this rate may therefore be increased in order to reverse said fluid flow.

In an embodiment, the placement fluid injection and/or the production in an adjacent wellbore is controlled during sealing fluid ejection in order to maintain said desired fluid flow. Thereby, the placement fluid injection and/or the production in an adjacent wellbore may gradually be adapted to the decreasing permeability of the fracture or thief zone as more and more sealing fluid is located in the fracture or thief zone. For instance, the placement fluid inflow rate and/or the production outflow rate in an adjacent wellbore may be decreased during sealing fluid ejection in order to maintain a placement fluid flow in the at least substantially annular space between the non-cemented perforated liner and the formation that is directed in the upstream direction at a position downstream the fracture or thief zone.

In an embodiment, sealing fluid ejection is terminated when said desired fluid flow cannot be maintained. Thereby, it may be ensured that the sealing fluid ejection may be continued until a suitable low permeability of the fracture or thief zone is obtained.

In an embodiment, said desired fluid flow is detected by comparing measurements performed by at least a first sensor and a second sensor distributed in at least two of the upstream section, the intermediate section and the downstream section. Thereby, a suitable indication of the direction of the placement fluid flow in the at least substantially annular space between the non-cemented perforated liner and the formation may be obtained. For instance, it may be sufficient to observe a certain balance between pressure readings in the intermediate section and the downstream section, respectively, or it may be sufficient to observe a certain balance between temperature readings in the upstream section and the downstream section, respectively. Such observations, possibly in combination with other measurements or known variables, such as placement fluid inflow rate, may be sufficient to conclude that the desired fluid flow in the at least substantially annular space between the non-cemented perforated liner and the formation has been obtained or is maintained.

In an embodiment, said desired fluid flow is detected when pressure readings from three pressure sensors distributed in respectively the upstream section, the intermediate section and the downstream section, are equal or substantially equal, or when a pressure reading from a pressure sensor in the intermediate section is lower than pressure readings from pressure sensors located in the upstream section and the downstream section, respectively. This may be a very good indication that said desired fluid flow has actually been obtained. A lower pressure reading in the intermediate section may be preferred in order to protect the remaining part of the wellbore from sealing fluid.

In an embodiment, said desired fluid flow is detected by detection and/or surveillance of a turn over point (TOP), at which flow directions diverge into upstream and downstream directions, respectively, in the at least substantially annular space in the downstream section of the liner, preferably by means of a distributed sensing system, such as a Distributed Temperature Sensing (DTS) system and/or a Distributed Acoustic Sensing (DAS) system. The presence of a turn over point may indicate the presence of a fluid flow in the at least substantially annular space that is directed in the upstream direction at a position downstream the fracture or thief zone, and thereby, the presence of said desired fluid flow. Furthermore, surveillance of the movement of the turn over point in the direction of the wellbore may assist in controlling the placement fluid injection during sealing fluid ejection in order to maintain said desired fluid flow as will be described in further detail below. The placement fluid injection may be controlled during sealing fluid ejection as a function of the actual position of the turn over point (TOP) in the longitudinal direction of the wellbore section.

In an embodiment, before ejection of sealing fluid, one or more supplemental apertures are created, preferably by means of a perforation tool included by the elongated body, in the non-cemented perforated liner at the position of the fracture or thief zone in the formation. Thereby, even better placement of the sealing fluid may be ensured, as a larger throughput area for the sealing fluid at the position of the fracture or thief zone may facilitate accurate and unrestricted flow of the sealing fluid in a proper direction.

In an embodiment, the sealing fluid includes a water swelling polymer carried by a carrier fluid, and whereby, preferably, the carrier fluid at least partially inhibits the swelling of the water swelling polymer. Thereby, the water swelling polymer may be conducted to the sealing fluid outlet through a conduit, such as for instance a coiled tubing, in a not-swelled or substantially not-swelled state, from the sealing fluid outlet it may be guided and/or carried into the fracture or thief zone by means of a current created by injected placement fluid in the form of water, such as sea water, whereby it may swell without or substantially without invading the matrix of the formation or rock as a result of its contact with the water. If the carrier fluid at least partially inhibits the swelling of the water swelling polymer, swelling may be minimised while the sealing fluid is conducted to the sealing fluid outlet, so that the relative swelling occurring when the sealing fluid is placed in the fracture or thief zone may be maximised.

The present invention furthermore relates to a sealing system for sealing a fracture or thief zone in a formation of a hydrocarbon reservoir surrounding a wellbore section of a wellbore having an upstream direction and a downstream direction, the wellbore section being provided with a non-cemented perforated liner, thereby forming an at least substantially annular space between the non-cemented perforated liner and the formation.

The sealing system is characterised in that it includes a placement tool including an elongated body adapted to be introduced into the non-cemented perforated liner, the elongated body being provided with a first and a second annular flow barrier arranged to extend to the liner and create inside the liner an upstream section, an intermediate section between the first and second annular flow barriers, and a downstream section, in that the placement tool includes a cross flow shunt tube allowing wellbore fluids to pass along the wellbore section between the upstream section and the downstream section, in that a sealing fluid outlet of the placement tool is arranged between the first and second annular flow barriers, in that the sealing system includes a control system adapted to control injection of a placement fluid, such as sea water, into the non-cemented perforated liner in the downstream direction and/or to control production from an adjacent wellbore in the formation in order for placement fluid to flow into the fracture or thief zone in the formation, in that the control system is adapted to control the placement fluid injection and/or to control the production from the adjacent wellbore in the formation to obtain a desired fluid flow in the at least substantially annular space between the non-cemented perforated liner and the formation that is directed in downstream direction at a position upstream the fracture or thief zone and that is directed in the upstream direction at a position downstream the fracture or thief zone, in that the control system includes a flow detection system adapted to detect when said desired fluid flow is present, and in that the control system is adapted to initiate ejection of sealing fluid from the sealing fluid outlet into the formation when the flow detection system detects said desired fluid flow. Thereby, the above-mentioned features may be obtained.

In an embodiment, the control system is adapted to control the placement fluid injection by controlling a placement fluid inflow rate at an upstream position of the wellbore section, and/or preferably by controlling a flow rate through the cross flow shunt tube in relation to the placement fluid inflow rate at the upstream position of the wellbore section, and additionally or alternatively by controlling the production in an adjacent wellbore. Thereby, the above-mentioned features may be obtained.

In an embodiment, the placement tool is provided with at least a first sensor and a second sensor distributed in at least two of the upstream section, the intermediate section and the downstream section, and wherein the flow detection system is adapted to detect said desired fluid flow by comparing measurements performed by the first sensor and the second sensor. Thereby, the above-mentioned features may be obtained.

In an embodiment, the placement tool is provided with a distributed sensing system, such as a Distributed Temperature Sensing (DTS) system and/or a Distributed Acoustic Sensing (DAS) system, included by the flow detection system. Thereby, the above-mentioned features may be obtained.

The invention will now be explained in more detail below by means of examples of embodiments with reference to the very schematic drawing, in which FIG. 1 illustrates a cross-sectional view through a wellbore section in a formation provided with a non-cemented perforated liner in which a placement tool of a sealing system has been inserted.

FIG. 1 illustrates a method according to the invention of sealing a fracture or thief zone 1 in a formation 2 of a hydrocarbon reservoir surrounding a wellbore section 3 having an upstream or uphole direction from the right to the left in the FIGURE, and a downstream or downhole direction from the left to the right in the FIGURE. The wellbore section 3 is provided with a non-cemented perforated liner 4, thereby forming an at least substantially annular space 5 between the non-cemented perforated liner 4 and the formation 2. It is noted that the at least substantially annular space 5 behind the non-cemented perforated liner 4 is theoretically unobstructed, even though in practice, some dirt, rocks etc. may somewhat provide a noticeable obstruction at certain spaces.

The wellbore section 3 may extend from a heel (inner part) in downhole direction to a toe (outer part) of a wellbore or the wellbore section 3 may be part of a wellbore having a heel and a toe, wherein the remaining part of the wellbore may have any other suitable kind of completion, such as for instance in the form of a conventional cemented and perforated liner.

The non-cemented perforated liner 4 may, as mentioned above, typically have the form of a so-called CAJ liner having a limited perforation optimized for acid stimulation of a well. The liner may subsequently to acid stimulation be used for water injection or oil production. Prior art methods of sealing fractures or thief zones in a formation are not suitable when a non-cemented perforated liner is located in a wellbore, because the sealing fluid may travel along the liner in the at least substantially annular space formed between the non-cemented perforated liner and the formation.

According to the invention, a placement tool 6 including an elongated body 7 is introduced into the non-cemented perforated liner 4 so that a first annular flow barrier 8 and a second annular flow barrier 9 arranged on the elongated body 7 extend to the liner 4 and create inside the liner 4 an upstream section 10, an intermediate section 11 between the first and second annular flow barriers 8, 9, and a downstream section 12. The first and second annular flow barriers 8, 9 may have the form of packers, such as cup packers, inflatable or high-expansion packers or any other suitable packer well known in the art. The annular flow barriers 8, 9 should suitably stop or impede or at least substantially impede flow across the annular flow barriers by suitably reaching, touching or sealing against the inside of the liner 4.

The placement tool 6 includes a cross flow shunt tube 13 allowing wellbore fluids to pass along the wellbore section 3 between the upstream section 10 and the downstream section 12. The cross flow shunt tube 13 runs through the first annular flow barrier 8 and the second annular flow barrier 9 and has a first inlet/outlet opening 16 located upstream the first annular flow barrier 8 and a second inlet/outlet opening 17 located downstream the second annular flow barrier 9. Furthermore, the placement tool 6 includes a sealing fluid outlet 14 arranged in the intermediate section 11 between the annular flow barriers 8, 9. The sealing fluid outlet 14 may be provided with a controllable valve in order to close the outlet when no sealing fluid has to be ejected. In the embodiment illustrated, the sealing fluid outlet 14 is supplied with sealing fluid via a coiled tubing 15 extending from a position above the wellbore at the surface of the formation 2, such as from a not shown wellhead.

However, the sealing fluid outlet 14 may alternatively be supplied with sealing fluid from a downhole container. It should be noted that although the cross flow shunt tube 13 and the coiled tubing 15 are illustrated in the FIGURE as being arranged side-by-side, it may be preferred to arrange the coiled tubing 15 coaxially with and within the cross flow shunt tube 13. Likewise, although not necessarily preferred, it would also be possible to arrange the cross flow shunt tube 13 inside a tubing or conduit, probably other than coiled tubing, supplying the sealing fluid outlet 14 with sealing fluid. In fact, the cross flow shunt tube 13 may have any suitable form of channel or channels formed in or outside the elongated body 7.

According to the invention, as illustrated in FIG. 1, the placement tool 6 is so positioned in the longitudinal direction of the wellbore section 3 that the intermediate section 11 is located at the fracture or thief zone 1 in the formation 2. The position of the fracture or thief zone 1 in the wellbore section may be determined by methods well-known in the art, such as for instance diagnostic instrumentation in the form of Distributed Temperature Sensing (DTS) and/or Distributed Acoustic Sensing (DAS).

Subsequently, a placement fluid, such as sea water or brine, is injected into the non-cemented perforated liner 4 in the downstream direction. Suitably, the placement fluid may be pumped down into the wellbore section 3 from a position above the formation 2, such as at a wellhead. However, a pump may be located at any suitable position along the wellbore.

Thereby, it is obtained that placement fluid flows out through perforations of the non-cemented perforated liner 4 and into the fracture or thief zone 1 in the formation 2. In FIG. 1, the perforations of the non-cemented liner 4, through which placement fluid flows, are not indicated; however, it should be understood that perforations are distributed over the entire length of the liner 4, so that placement fluid flows into the at least substantially annular space 5 between the non-cemented perforated liner 4 and the formation 2 and thereby may form a desired fluid flow as indicated by the arrows 18, 19, 20 in the FIGURE.

The desired fluid flow in the at least substantially annular space 5 between the non-cemented perforated liner 4 is, as indicated by the arrows 18, directed in downstream direction at a position upstream the fracture or thief zone 1, and, as indicated by the arrows 19, directed in the upstream direction at a position downstream the fracture or thief zone 1. Thereby, the sealing fluid may be guided and/or carried into the fracture or thief zone 1 by means of a current created by the injected placement fluid, said current being formed in the at least substantially annular space 5 between the non-cemented perforated liner 4 and the formation 2 and being directed at the fracture or thief zone 1 from both upstream and downstream sides, and proper placement of the sealing fluid in the fracture or thief zone 1 may be obtained even by limited access through the perforations of the liner 4.

The injected placement fluid is preferably seawater, and should preferably be a fluid having a suitably low viscosity enabling the placement fluid to properly enter the fracture or thief zone 1 and thereby guide and/or carry the sealing fluid into the fracture or thief zone 1. A placement fluid having a viscosity corresponding to that of seawater will normally be suitable, and the viscosity should at least be lower, preferably 5, 10 or 20 times lower, than that of the sealing fluid.

Alternatively, or in addition to, injecting a placement fluid into the non-cemented perforated liner 4, fluid, such as hydrocarbons and/or water, may be produced from an adjacent wellbore in the formation in order to create the above-mentioned desired fluid flow. The desired fluid flow may be created in this way as a consequence of a pressure drop over the fracture or thief zone 1 in the formation 2 from the wellbore section 3 provided with the non-cemented perforated liner 4 to the adjacent wellbore from which fluid is produced. If placement fluid is not injected into the non-cemented perforated liner 4, but fluid is produced from the adjacent wellbore, wellbore fluids may flow, possibly predominantly from the formation in the toe section, of the wellbore section 3 to the fracture or thief zone 1.

If the fracture or thief zone 1 is not positioned next to the toe of the wellbore, there will, at least by injection of placement fluid, according to the desired fluid flow, also exist a fluid flow in the at least substantially annular space 5 directed in the downstream direction at a position further downstream the fracture or thief zone 1, as illustrated by the arrows 20. Thereby, a so-called Turn Over Point (TOP) is created, as indicated in the FIGURE, where the flows are separated into upstream and downstream directions, respectively. During ejection of sealing fluid and placement of the sealing fluid in the fracture or thief zone 1, as a result of the fracture or thief zone 1 being sealed gradually by the sealing fluid, thereby lowering the rate of placement fluid entering the fracture or thief zone 1, the turn over point, TOP, will travel in upstream direction, thereby approaching the fracture or thief zone 1. Detection of the actual position and movement of the turn over point may assist or be the basis of a flow detection system adapted to detect when said desired fluid flow is present, as described in further detail below.

In order to obtain said desired fluid flow in the at least substantially annular space 5, the placement fluid injection and/or the production in the adjacent wellbore is controlled by means of a not shown control system, such as a computer based control system.

When said desired fluid flow is obtained, sealing fluid is ejected from the sealing fluid outlet 14 into the formation 2. The ejection of sealing fluid may be controlled and initiated by the not shown control system based on a signal from a flow detection system, including sensors $P_h$, $P_f$, $P_t$, adapted to detect when said desired fluid flow is present.

The placement fluid injection may be controlled to obtain said desired fluid flow by controlling a placement fluid inflow rate at an upstream position of the wellbore section 3, for instance by means of a not shown pump positioned above the formation 2. The placement fluid injection may alternatively or additionally be controlled to obtain said desired fluid flow by controlling a flow rate through the cross flow shunt tube 13 in relation to the placement fluid inflow rate at an upstream position of the wellbore section 3.

For instance, the cross flow shunt tube 13 may be provided with a not shown pump, whereby the flow rate in downstream direction through the cross flow shunt tube 13 may be increased or even decreased. The pump may for instance be an Electrical Submersible Pump (ESP) with a Variable Speed Drive (VSD). The cross flow shunt tube 13 may alternatively or additionally be provided with a controlled valve. Thereby, the relation between the rate of placement fluid supplied to the upstream section 10 and the downstream section 12, respectively, of the non-cemented perforated liner 4 may be controlled, so that said desired fluid flow may be obtained. The pump and/or valve may be controlled on the basis of measurements performed by the flow detection system, including sensors $P_h$, $P_f$, $P_t$, and communicated via cable communication link to surface and/or with a not shown downhole local control unit.

Furthermore, the placement fluid injection may be controlled during sealing fluid ejection in order to maintain said desired fluid flow as long as the sealing fluid ejection takes place, thereby gradually adapting the placement fluid injection to the decreasing permeability of the fracture or thief zone as more and more sealing fluid is located in the fracture or thief zone. Thereby, the placement fluid inflow rate may be decreased during sealing fluid ejection. By doing this, it may furthermore be ensured that the pressure in the fracture or thief zone 1 is not increased to levels that could lead to the formation breaking up whereby the fracture could propagate or new fractures could be generated. The limiting pressure level may be referred to as the fracture closure pressure (FCP). Finally, sealing fluid ejection is terminated when said desired fluid flow cannot be maintained. The placement fluid injection may for instance be controlled during sealing fluid ejection as a function of the actual position of the turn over point (TOP) in the longitudinal direction of the wellbore section 3. When the turn over point is about to reach or reaches the position of the fracture or thief zone 1, the sealing fluid ejection may suitably be terminated.

The production in an adjacent wellbore may be controlled to obtain said desired fluid flow by controlling a fluid outflow rate at an upstream position of the adjacent wellbore.

Said desired fluid flow may be detected by comparing measurements performed by at least a first sensor and a second sensor distributed in at least two of the upstream section 10, the intermediate section 11 and the downstream section 12.

In the embodiment illustrated in FIG. 1, said desired fluid flow is detected when pressure readings from three pressure sensors, $P_h$ (Pressure, heel), $P_f$ (Pressure, fracture), $P_t$ (Pressure, toe), distributed in respectively the upstream section 10 (pressure sensor $P_h$), the intermediate section 11 (pressure sensor $P_f$) and the downstream section 12 (pressure sensor $P_t$), are equal or substantially equal. However, it may be preferred that a pressure reading from the pressure sensor ($P_f$) in the intermediate section 11 is lower than pressure readings from the pressure sensors $P_h$, $P_t$, located in the upstream section 10 and the downstream section 12, respectively. This may be a very good indication that said desired fluid flow has actually been obtained. A lower pressure reading in the intermediate section 11 may be preferred in order to protect the remaining part of the wellbore from sealing fluid.

The above mentioned sensors may, apart from pressure sensors, be temperature sensors, flow sensors, chemical sensors, optical sensors, pH sensors or any other suitable type of sensor or combination of sensor that may provide useful information about the fluid flow in the liner 4 and especially in the at least substantially annular space 5.

Additionally, or alternatively, to the above described possible arrangements of sensors, the flow detection system may be based on a distributed sensing system, such as a Distributed Temperature Sensing (DTS) system and/or a Distributed Acoustic Sensing (DAS) system. DTS systems are optoelectronic devices which measure temperatures by means of optical fibres functioning as linear sensors. Temperatures are recorded along the optical sensor cable, thus not at points, but as a continuous profile. DAS systems use fibre optic cables to provide distributed strain sensing. In DAS, the optical fibre cable becomes the sensing element and measurements are made, and in part processed, using an attached optoelectronic device. Such a system allows acoustic frequency strain signals to be detected over large distances and in harsh environments.

In FIG. 1, the placement tool 6 is provided with a fibre optic cable 21 forming part of a distributed sensing system included by the flow detection system of the sealing system according to an embodiment of the invention. The fibre optic cable 21 extends from the placement tool 6 in the downstream section of the liner 4, in the direction of the toe of the wellbore. The fibre optic cable 21 could for instance have a length of 100-200 meters, but the length may be adapted to the actual conditions.

By means of the fibre optic cable 21 forming part of a distributed sensing system, the actual position of the turn over point, TOP, along the length of the wellbore may be detected by temperature sensing and/or by acoustic sensing. This detection is possible, because variables, such as temperature and sound will change in the region of the turn over point, also inside the non-cemented perforated liner 4, where the fibre optic cable 21 may be located.

As explained above, as a result of the fracture or thief zone 1 being sealed gradually by the sealing fluid, the turn over point, TOP, will travel in upstream direction, thereby approaching the fracture or thief zone 1. Therefore, detection of the actual position and movement of the turn over point may assist or be the basis of a flow detection system adapted to detect when said desired fluid flow is present.

As an alternative to the fibre optic cable 21, an extended array of sensors may be used, such as a cable provided with a number of discrete sensors distributed over its length. Such sensors may be pressure sensors, temperature sensors, flow sensors, chemical sensors, optical sensors, pH sensors or any other suitable type of sensor or combination of sensor that may provide useful information about the fluid flow in the liner 4 and especially in the at least substantially annular space 5.

Before ejection of sealing fluid, one or more supplemental apertures 22 may be created, preferably by means of a perforation tool known per se, included by the placement tool, in the non-cemented perforated liner at the position of the fracture or thief zone in the formation. Thereby, a larger throughput area for the sealing fluid at the position of the fracture or thief zone may facilitate accurate and unrestricted flow of the sealing fluid in a proper direction. The one or more supplemental apertures 22 may, subsequently to sealing of the fracture or thief zone, be plugged by sealing fluid. Furthermore, subsequently to sealing of the fracture or thief zone 1 in the formation 2, by means of sealing fluid ejection, a ring-formed plug may be formed in the at least substantially annular space 5 between the non-cemented perforated liner 4 and the formation 2.

In an embodiment, the sealing fluid includes a water swelling polymer carried by a carrier fluid. CrystalSeal (Registered Trademark) is an example of a suitable commercially available water-swellable synthetic polymer capable of absorbing up to 400 times its own weight in sweet water. The rate of absorption can be controlled based on the particle size and carrier fluid.

Preferably, the carrier fluid at least partially inhibits the swelling of the water swelling polymer. In the case of CrystalSeal, a suitable carrier fluid is a high salinity fluid or a hydrocarbon-based fluid.

Other types of sealing fluid may be employed, such as for instance epoxy resins and elastomers or crosslinked, non-damaging derivati natural polymers, among others, depending on the actual conditions.

The method according to the invention of sealing a fracture or thief zone 1 in a formation 2 may be repeated one or more times before or during acid stimulation and/or before or during stimulation or production.

The invention claimed is:

1. A method of sealing a fracture or thief zone in a formation of a hydrocarbon reservoir surrounding a wellbore section of a wellbore having an upstream direction and a downstream direction, the method comprising:

providing the wellbore section with a non-cemented perforated liner, thereby forming an at least substantially annular space between the non-cemented perforated liner and the formation;

introducing a placement tool including an elongated body into the non-cemented perforated liner so that a first and a second annular flow barrier arranged on the elongated body extend to the non-cemented perforated liner and create inside the non-cemented perforated liner an upstream section, an intermediate section between the first and second annular flow barriers, and a downstream section, wherein the placement tool includes a cross flow shunt tube allowing wellbore fluids to pass along the wellbore section between the upstream section and the downstream section, wherein a sealing fluid outlet of the placement tool is arranged in the intermediate section;

positioning the placement tool in the longitudinal direction of the wellbore section that the intermediate section is located at the fracture or thief zone in the formation;

causing a placement fluid to flow into the fracture or thief zone in the formation by one or both of:

injection of the placement fluid into the non-cemented perforated liner in the downstream direction so that the placement fluid flows out through perforations of the non-cemented perforated liner; and production from an adjacent wellbore in the formation;

detecting a fluid flow between the non-cemented perforated liner and the formation;

in response to the detection, controlling the placement fluid injection or the placement fluid production in the adjacent wellbore to control the fluid flow in the at least substantially annular space between the non-cemented perforated liner and the formation that is directed in the downstream direction at a position upstream the fracture or thief zone and that is directed in the upstream direction at a position downstream the fracture or thief zone; and whereby, when the fluid flow is obtained, a sealing fluid is ejected from the sealing fluid outlet into the formation.

2. The method according to claim 1, whereby the placement fluid injection is controlled to obtain said fluid flow by controlling a placement fluid inflow rate at an upstream position of the wellbore section, and whereby additionally or alternatively, the production in an adjacent wellbore is controlled to obtain said fluid flow by controlling a fluid outflow rate at an upstream position of the adjacent wellbore.

3. The method according to claim 2, whereby the placement fluid injection is controlled to obtain said fluid flow by controlling a flow rate through the cross flow shunt tube in relation to a placement fluid inflow rate at an upstream position of the wellbore section.

4. The method according to claim 2, whereby the one or both of the: placement fluid injection and the production in an adjacent wellbore is controlled during sealing fluid ejection in order to maintain said fluid flow.

5. The method according to claim 2, whereby sealing fluid ejection is terminated when said fluid flow cannot be maintained.

6. The method according to claim 2, whereby said fluid flow is detected by comparing measurements performed by at least a first sensor and a second sensor distributed in at least two of the upstream section, the intermediate section and the downstream section.

7. The method according to claim 1, whereby the placement fluid injection is controlled to obtain said fluid flow by controlling a flow rate through the cross flow shunt tube in relation to a placement fluid inflow rate at an upstream position of the wellbore section.

8. The method according to claim 1, whereby the one or both of: the placement fluid injection and the production in an adjacent wellbore is controlled during sealing fluid ejection in order to maintain said fluid flow.

9. The method according to claim 1, whereby sealing fluid ejection is terminated when said fluid flow cannot be maintained.

10. The method according to claim 1, whereby said fluid flow is detected by comparing measurements performed by at least a first sensor and a second sensor distributed in at least two of the upstream section, the intermediate section and the downstream section.

11. The method according to claim 1, whereby said fluid flow is detected when pressure readings from three pressure sensors ($P_h$, $P_t$, $P_i$) distributed in respectively the upstream section, the intermediate section and the downstream section, are equal or substantially equal, or when a pressure reading from a pressure sensor (Pt) in the intermediate section is lower than pressure readings from pressure sensors ($P_h$, $P_i$) located in the upstream section and the downstream section, respectively.

12. The method according to claim 1, whereby said fluid flow is detected by one or both of: detection and surveillance of a turn over point (TOP), at which flow directions diverge into upstream and downstream directions, respectively, in the at least substantially annular space in the downstream section of the liner via a sensing system.

13. The method according to claim 12, wherein the sensing system corresponds to a distributed sensing system that includes one or more of: a Distributed Temperature Sensing (DTS) system and a Distributed Acoustic Sensing (DAS) system.

14. The method according to claim 1, whereby, before ejection of sealing fluid, one or more supplemental apertures are created via a perforation tool included by the placement tool, in the non-cemented perforated liner at the position of the fracture or thief zone in the formation.

15. The method according to claim 1, whereby the sealing fluid includes a water swelling polymer carried by a carrier fluid, and whereby, preferably, the carrier fluid at least partially inhibits the swelling of the water swelling polymer.

16. A sealing system for sealing a fracture or thief zone in a formation of a hydrocarbon reservoir surrounding a wellbore section of a wellbore having an upstream direction and a downstream direction, the wellbore section being provided with a non-cemented perforated liner, thereby forming an at least substantially annular space between the non-cemented perforated liner and the formation, wherein the sealing system includes:

a placement tool that includes:

an elongated body adapted to be introduced into the non-cemented perforated liner, the elongated body includes:

a first and a second annular flow barrier arranged to extend to the liner and create inside the liner an upstream section; and an intermediate section between the first and second annular flow barriers, and a downstream section;

a cross flow shunt tube allowing wellbore fluids to pass along the wellbore section between the upstream section and the downstream section; and a sealing fluid outlet arranged between the first and second annular flow barriers, in that the sealing system includes;

a flow detection system adapted to detect fluid flow between the non-cemented perforated liner and the formation; and a control system in communication with the flow detection system adapted to control one or both of: injection of a placement fluid into the non-cemented perforated liner in the downstream direction and production from an adjacent wellbore in the formation in order for placement fluid to flow into the fracture or thief zone in the formation, wherein the control system is adapted to control the placement fluid injection or to control the production from the adjacent wellbore in the formation to obtain a fluid flow in the at least substantially annular space between the non-cemented perforated liner and the formation that is directed in downstream direction at a position upstream the fracture or thief zone and that is directed in the upstream direction at a position downstream the fracture or thief zone, and initiate ejection of sealing fluid from the sealing fluid outlet into the formation when the flow detection system detects said fluid flow.

17. The sealing system according to claim 16, wherein the control system is adapted to control the placement fluid injection by controlling one or both of: a placement fluid inflow rate at an upstream position of the wellbore section, and a flow rate through the cross flow shunt tube in relation to the placement fluid inflow rate at the upstream position of the wellbore section, and additionally or alternatively by controlling the production in an adjacent wellbore.

18. The sealing system according to claim 17, wherein the placement tool is provided with at least a first sensor and a second sensor distributed in at least two of the upstream section, the intermediate section and the downstream section, and wherein the flow detection system is adapted to detect said fluid flow by comparing measurements performed by the first sensor and the second sensor.

19. The sealing system according to claim 17, wherein the flow detection system is provided with a distributed sensing system.

20. The sealing system according to claim 19, wherein the distributed sensing system includes one or more of: a Distributed Temperature Sensing (DTS) system and a Distributed Acoustic Sensing (DAS) system.

21. The sealing system according to claim 16, wherein the placement tool is provided with at least a first sensor and a second sensor distributed in at least two of the upstream section, the intermediate section and the downstream section, and wherein the flow detection system is adapted to detect said fluid flow by comparing measurements performed by the first sensor and the second sensor.

22. The sealing system according to claim 16, wherein the flow detection system is provided with a distributed sensing system.

23. The sealing system according to claim 22, wherein the distributed sensing system includes one or more of: a Distributed Temperature Sensing (DTS) system and a Distributed Acoustic Sensing (DAS) system.

* * * * *